United States Patent [19]

Beatty

[11] Patent Number: 4,731,941

[45] Date of Patent: Mar. 22, 1988

[54] DRAGLINE HOE, METHOD AND APPARATUS

[75] Inventor: Robert A. Beatty, Queensland, Australia

[73] Assignee: R. A. Beatty & Associates Pty., Limited, Queensland, Australia

[21] Appl. No.: 913,733

[22] Filed: Sep. 30, 1986

[30] Foreign Application Priority Data

Oct. 2, 1985 [AU] Australia ..... 02720

[51] Int. Cl.[4] ..... E02F 3/48; E02F 3/60

[52] U.S. Cl. ..... 37/115; 37/195; 172/26.6

[58] Field of Search ..... 37/115, 116, 117, 135, 37/195, 136, 125, 71; 172/26.5, 26.6; 299/18

[56] References Cited

U.S. PATENT DOCUMENTS

| | | | |
|---|---|---|---|
| 1,283,932 | 11/1918 | Slocum | 37/117 |
| 1,646,536 | 10/1927 | Housman | 172/26.5 |
| 1,760,840 | 5/1930 | Enard | 37/115 X |
| 1,804,175 | 5/1931 | Massey | 37/117 |
| 2,013,276 | 9/1935 | Luce | 37/125 |
| 2,402,314 | 6/1946 | Crane | 172/26.5 X |
| 2,763,074 | 9/1956 | Whisler | 172/26.6 |
| 2,864,182 | 12/1958 | Russell | 37/125 |
| 3,445,945 | 5/1969 | Howell | 37/116 |

FOREIGN PATENT DOCUMENTS

| | | | |
|---|---|---|---|
| 18277 | 2/1929 | Australia | 37/115 |
| 569610 | 2/1933 | Fed. Rep. of Germany | 37/115 |
| 845330 | 7/1952 | Fed. Rep. of Germany | 37/117 |
| 941362 | 4/1956 | Fed. Rep. of Germany | 37/115 |
| 915938 | 4/1946 | France | 37/117 |
| 1133399 | 1/1985 | U.S.S.R. | 299/18 |

*Primary Examiner*—Clifford D. Crowder

*Attorney, Agent, or Firm*—Renner, Otto, Boisselle & Lyon

[57] ABSTRACT

Method of excavating overburden from a mineral or coal deposit seam using a low wall winch component, a high wall which component and a hoe. The hoe is attached to the low wall winch component by one or more draglines and the hoe is attached to the high wall winch component by a tail line.

The method includes the steps of:

(i) moving the hoe by tensioning of the draglines by the low wall winch component through overburden created by preliminary drilling and blasting to move said overburden away from the mineral or coal deposit seams in one or more traverses wherein overburden is loaded onto the hoe and subsequently dumped onto a spoil bank; and (ii) moving the hoe at the end of the or each traverse back to the starting point of the traverse by untensioning of the draglines by the low wall winch component and tensioning of the tail line by the high wall winch component.

There is also included dragline apparatus including the aforementioned low wall winch component, high wall winch component, and the hoe.

23 Claims, 20 Drawing Figures

DRAGLINE HOE, METHOD AND APPARATUS

This invention relates to improved dragline apparatus suitable for mining or excavating purposes and method of use of same.

BACKGROUND

Conventional draglines include a dragline housing which incorporates a hoist winch, an outwardly extending boom carrying a hoist cable connected to the hoist winch which may extend downwardly from an outer end of the boom attached so an excavator bucket as hereinafter described and a drag cable attached to the excavator bucket which is connected to a drag winch located in the dragline hoising. Both the drag winch and hoist winch are suitably driven from electric motors and the dragline housing is suitably rotatably mounted to a support base by a central bearing. The dragline housing may be equipped with crawler tracks for locomotion or alternatively and more commonly is equipped with a walking mechanism having a pair of support feet which are reciprocatable relative to the dragline housing and thus may propel the dragline housing in a desired direction of travel.

The excavator bucket is usually arcuate in shape having a base and upper side wall provided with an open front or access mouth whereby soil or overburden may gain access to the interior of the bucket as the bucket is dragged or moved through loose overburden by the drag cable(s). A plurality of ripper teeth along a free edge of the base may be provided in the open front or access mouth.

The rear end of the excavator bucket is provided with a pair of opposed support chains each attached to a respective support lug on the external face of the upper side wall. The chains may be interconnected by a horizontal bar. The hoist cable(s) may be split into two half portions or hoist cable components wherein each component is attached to an associated end of the horizontal bar.

There also may be provided a support loop adjacent the open front of the bucket to which may be attached further cable(s) connected to the hoist cable(s) and also to the drag cable(s) by use of an appropriate sheave mechanism. There also may be provided a pair of drag chains attached to each front vertical edge of the upper wall which are each attached to the drag cable(s).

The abovementioned conventional dragline operates to remove overburden or to mine a mineral from a valuable mineral or coal deposit such as a coal seam. After initially drilling and blasting the overburden by a suitable explosive such as ammonium nitrate, the overburden is loosened and softened. A bulldozer was then used to level a portion of the overburden to provide a flattened hill for supporting the dragline housing. The excavator bucket was then moved to the desired location wherein the drag winch was free spinning so that the drag cable was slack. In this movement the hoist winch has enough tension to hold the excavator bucket as it swings freely when suspended from the boom. Then the excavator bucket is placed on the ground by actuation of the hoist cable and tension is subsequently applied to the drag cables. The bucket is subsequently dragged through the loose overburden until it is full. The tension is then maintained in the drag cables and tension is applied to the hoist cables to elevate the full bucket above the overburden. By balanced control of the hoist winch and drag winch the bucket may then be moved towards the top of the boom which has a sheave for supporting the hoist cable. The dragline housing is then rotated away from the excavation site towards a spoil pile or dump from the overburden in the bucket and is tipped out of the excavator bucket by slackening of the tension in the drag cables. By appropriate control of the hoist cable the empty excavator bucket then assumes its normal orientation and is then moved back to the excavation site by rotation of the dragline housing.

The abovedescribed conventional dragline apparatus had several disadvantages and one major disadvantage was that it was constrained by geometric or physical size parameters such as the length of the hoist cable and drag cable(s) and/or the length of the boom excavation site. Thus for example, if a coal seam was too deep for the cables then "rehandling operations" were necessary wherein material already removed or dug by the excavator bucket is dug again by auxiliary or companion excavation equipment such as a bucket wheel excavator or repositioning of the dragline. Thus in relation to a particular mine if the coal seam was too deep for the physical parameters of the machine it was necessary to carry out a prestripping operation by truck and shovel, bucket wheel excavator or scraper to remove the top level of overburden. Rehandling or prestripping operations were found to be very expensive in practice and insufficient in relation to the depth of the open cut excavation site. Thus in other words, as the depth increased, there was a tendency for the spoil pile and high wall excavation material separating the excavation site and the flattened hill supporting the dragline housing to subside and fall into the open cut excavation site.

It therefore is an object of the invention to provide a dragline apparatus and method of use which may alleviate the abovementioned disadvantages associated with the prior art.

SUMMARY OF THE INVENTION

The method of the invention is a method of excavating overburden from a mineral or coal deposit seam using a low wall winch component, a high wall winch component and a hoe wherein the hoe is attached to the low wall winch component by one or more draglines and the hoe is attached to the high wall winch component by a tail line including the following steps:

(i) moving the hoe by tensioning of the draglines by the low wall winch component through overburden created by preliminary drilling and blasting to move said overburden away from the mineral or coal deposit seams in one or more traverses wherein overburden is loaded onto the hoe and subsequently dumped onto a spoil bank; and (ii) moving the hoe at the end of the or each traverse back to the starting point of the traverse by intensioning of the draglines by the low wall winch component and tensioning of the tail line by the high wall winch component.

The invention also includes within its scope dragline apparatus for carrying out the aforementioned method including:

(A) a low wall winch component comprising
- a housing;
- a boom extending outwardly from the housing for supporting one or more draglines;
- winch means for rotatably carrying said one or more draglines;

drive means for actuating movement of the winch means; and transversing means supporting the housing (B) a high wall winch component comprising a housing;

a boom extending outwardly from the housing for supporting a tail line;

winch means for rotatably carrying said tail line; drive means for actuating movement of the winch means; and traversing means supporting the housing, and (C) an excavating hoe attachable to said one or more draglines at one end and said tail line at another end.

The terms "high wall" and "low wall" as used herein refer to the opposing slopes or walls of an excavation site wherein one wall is of greater height (i.e. the high wall) than the other wall (i.e. the low wall) before mining takes place.

The high wall winch component may include a single winch drum operated by appropriate drive means although a set of in line winch drums could be used if necessary. The winch drum(s) may be mounted by a movable housing which also may have an outwardly extending boom for supporting a high wall cable. The boom may have a free outer end to which a pulley or sheave is attached for control of the high wall cable. A suitable drive means for the winch drum may include a series of drive motors drivingly connected to the winch drum by appropriate gearing means or bearing means. A suitable source of electricity supply such as a generator or the like may be provided for providing power to the electric motors. However, it will also be appreciated that external power from the mains may be used for providing power to the electric motors.

The housing is suitably rotatably mounted to a suitable support base and in one form this may include the housing mounted to a central bearing of the support base. There also may be provided a swing rack or rack of round shape which may meshingly engage with a suitable drive motor by appropriate gearing or bearing means.

The housing may also be equipped for movement in any desired direction and in one form the housing may be moved by a pair of reciprocatable feet as described below for the low wall winch component. However, more preferably, the housing is supported by a pair of opposed crawler tracks.

The low wall winch component if desired may be similar in construction to the high wall winch component as described above. However, more suitably, the low wall winch component includes a pair of in line winch drums although a single winch drum may be used in some circumstances. Each winch drum may be driven by suitable drive motors as described above. There also may be provided a housing for supporting the winch drum(s). There also may be provided an outwardly extending boom for supporting one or a plurality of low wall cables. To this end the boom may have an outer end to which is attached one or a plurality of opposed sheaves or pulleys for controlling a respective low wall cable. The housing may also have a suitable source of electric supply or use external power as described above and be provided with traversing or moving means such as a pair of crawler tracks or more suitably a pair of traversing feet which operate in a similar manner to a conventional dragline apparatus as described above.

The housing may also be rotatably mounted on a suitable support base in a similar manner as described above for the high wall winch. Thus there may be provided a central bearing or pintle bearing interconnecting the housing and the support base. There also may be provided a swing rack as described above driven by one or more preferably a plurality of drive motors. The swing rack may be welded or rigidly attached to the support base.

There also may be provided auxiliary support means in the form of bearing rollers interconnecting mating abutments of the support base and the housing.

When it is required to move the low wall winch component, the housing may be rotated to face in a direction opposite to the desired direction of travel and the feet are suitably located on opposed sides of the housing and reciprocate in an associated slot. The feet may then move rearwardly and drag the support base in the direction of travel. The operation may be operated by a pair of pantograph links or alternatively is cam operated.

The excavator implement for use in the invention may be of any suitable type such as a bucket having an open top and open front. Preferably, however, the excavator implement is an excavating hoe including:

a body portion suitably of imperforate type;

a blade portion extending downwardly from the body portion and hingedly attached thereto; and a pair of opposed side members attached to or intergral with the body portion and adapted for lateral scraping of overburden;

first attachment means for one or more draglines; and second attachment means for a tail line.

Further in accordance with the invention, the body portion has a generally horizontally disposed bottom surface formed, in particular, by a plate or mesh sheet for floating the body portion on a load of scraped material advanced by the blade portion and plural spikes or the like extending downwardly from the bottom surface for retaining scraped material under the hoe, whereby working of the load of scraped material is minimized.

BRIEF DESCRIPTION OF THE DRAWINGS

There is now shown and illustrated in the attached drawings a preferred embodiment of the invention. In the drawings.

DETAILED DESCRIPTION

Figure 1:
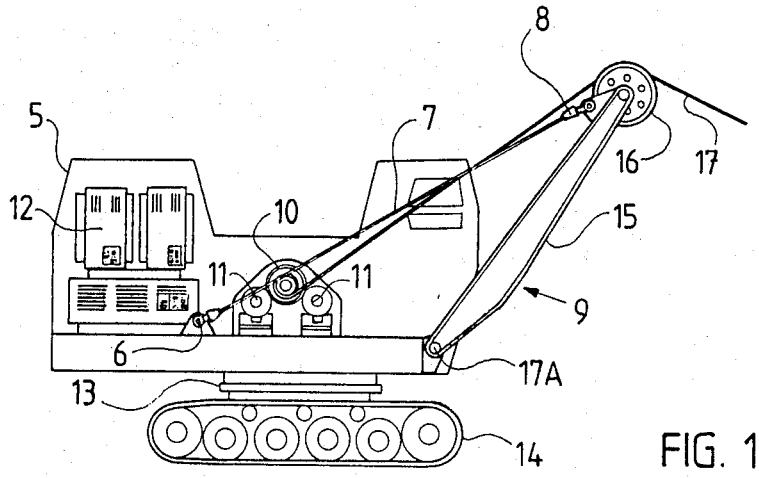
FIG. 1 represents a side elevation of a high wall winch component constructed in accordance with the invention.
Figure 2:
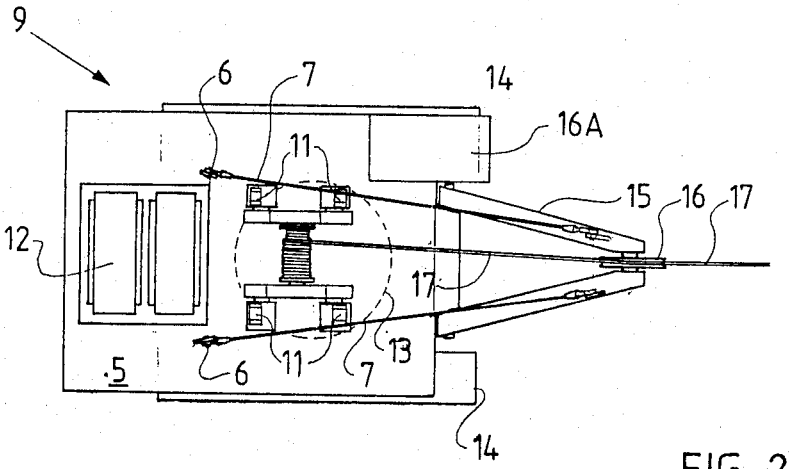
FIG. 2 represents a plan view of the high wall winch component shown in FIG. 1.

In the high wall winch component 9 shown in FIGS. 1–2 there is included housing 5, boom attachment cables 7, attachment cable support brackets 6 located on housing 5, attachment cable brackets 8 associated with boom 15, winch drum 10, drive motors 11 for actuating rotation of winch drum 10, electrical supply 12, circular swing rack 13, crawler tracks 14, sheave or pulley 16 and tail cable or line 17. For convenience the drive means for effecting rotation of housing 5 is shown in the low wall winch component shown in FIGS. 3–4. The boom 15 is pivoted to housing 5 at 17A and may easily be retracted or extended as desired by engagement or disengagement of support cables 7. Also shown is control cabin 16A.

Figure 3:
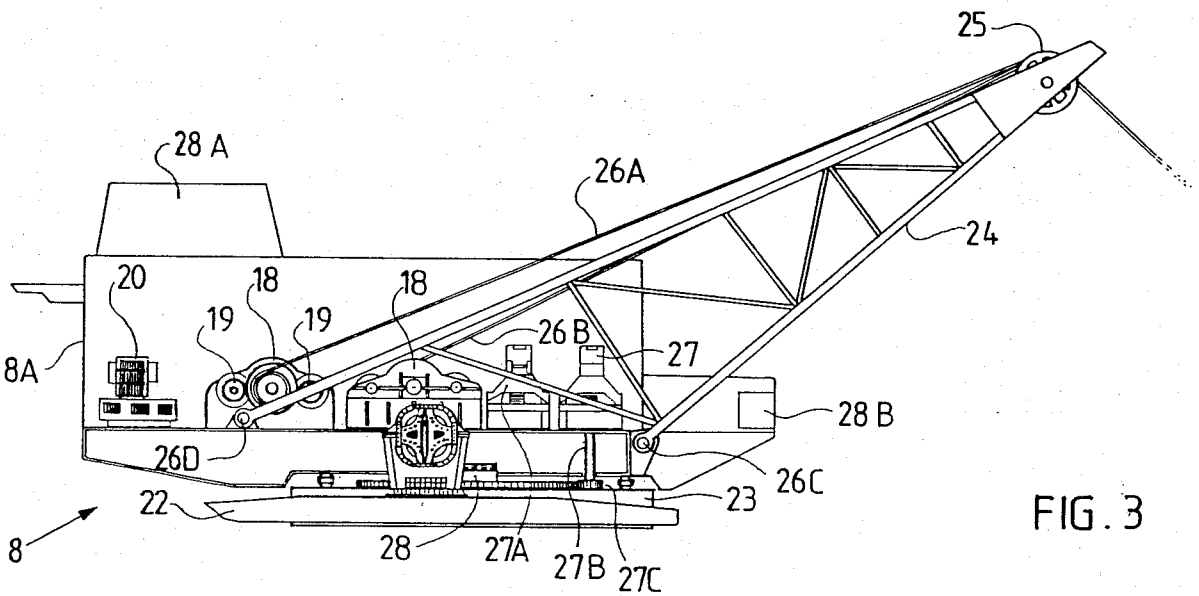
FIG. 3 represents a side elevation of a low wall winch component constructed in accordance with the invention.
Figure 4:
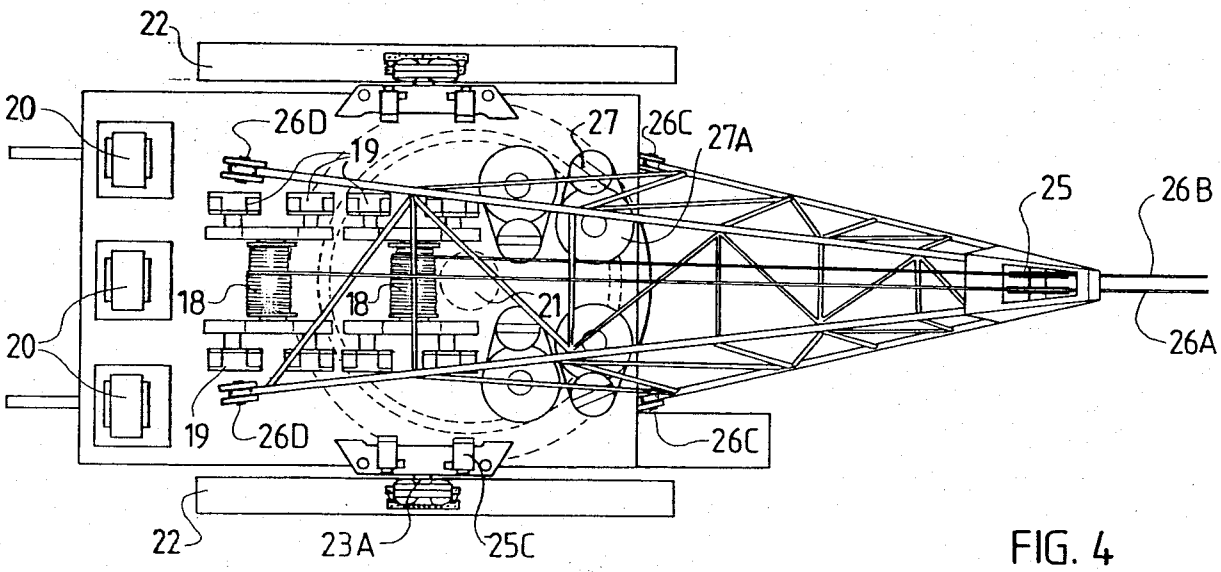
FIG. 4 represents a plan view of the low wall winch component shown in FIG. 3.

In the low wall winch component 8 shown in FIGS. 3–4 there is included housing 8A, a pair of winch drums 18 driven by drive motors 19, electrical supply 20, centre pintle bearing 21, support base 23, boom 24, sheave or pulley 25, drag cables 26A and 26B respectively and electric motor 27 for effecting rotation of swing rack 28. As shown is motor 27 which through gearbox 27A has drive shaft 27B which has pinion 27C which meshes with swing rack 28. Also shown is walking members 22 as well as ventilation box 28A and control cabin 28B. The boom 24 is pivoted to housing 8A at 26C and also at 26D. There is also shown actuating mechanism 22A for effecting elevating and lowering of members 22 which is shown in more detail in FIGS. 4A and 4B.

Figure 4A:
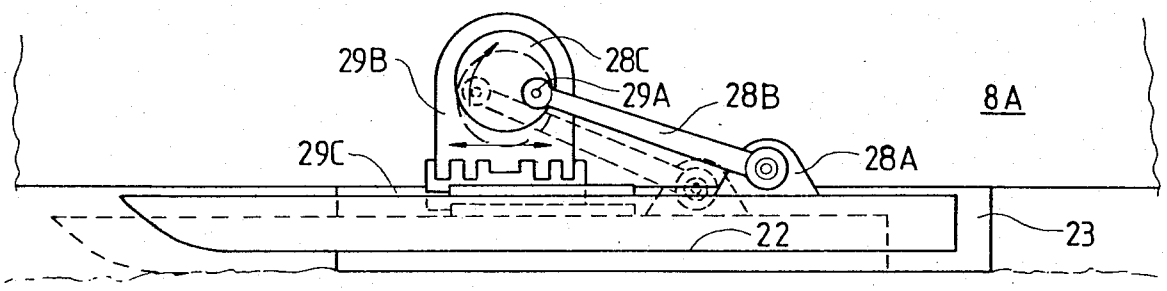
FIGS. 4A and 4B represent two alternative mechanisms for walking means suitable for the low wall winch component.
Figure 4B:
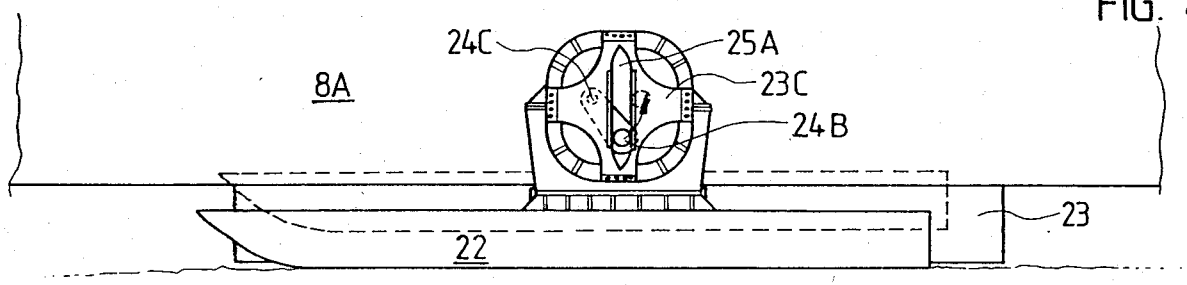

The actuating mechanism 22A for effecting raising and lowering of walking members 22 may be one of two alternative types as shown in FIGS. 4A and 4B.

In FIG. 4A the walking member 22 is provided with lug 28A having cam follower 28B attached to cam 28C. Cam 28C has an axle (not shown) collinear with pin 29A. As cam 28C rotates and thus causes corresponding movement of follower 28B this causes support member 29B to slide in the slideway 29C and thus base 23 while off the ground moves forwardly relative to walking members 22. The base 23 is then placed on the ground when the pin 29A has passed the apex of its motion and at the same time walking members 22 are on the ground. Subsequently walking members 22 are lifted off the ground and move relative to base 23 and then are placed on the ground in an advanced location. While this cam and slide walking mechanism is descriped only schematically in FIG. 4A, this is a conventional mechanism and is illustrated more comprehensively in a publication entitled "Surface Mining Machinery" by Bucyrus-Erie Company in the U.S.A.

In FIG. 4B another suitable walking mechanism is illustrated wherein there is provided a pin 24B reciprocatable in a slot 25A. The pin may be attached to a crank 24C which may also engage with an axle 23A rotatably mounted on housing 8A. The pin may also be attached to the periphery of a cam (not shown) which is driven by drive motors 25C shown in FIG. 4. As the pin 24B moves downwardly towards the end of slot 25A this will lift base 23 off the ground relative to walking members 22 which are stationary. As the pin 24B approaches the top end of slot 25A this is turn will lift walking members 22 up and then down a distance in advance of their original position. Also shown is support structure 23C containing slot 25A. Again this walking mechanism is a conventional one and illustrated in the aforementioned publication.

Figure 5:
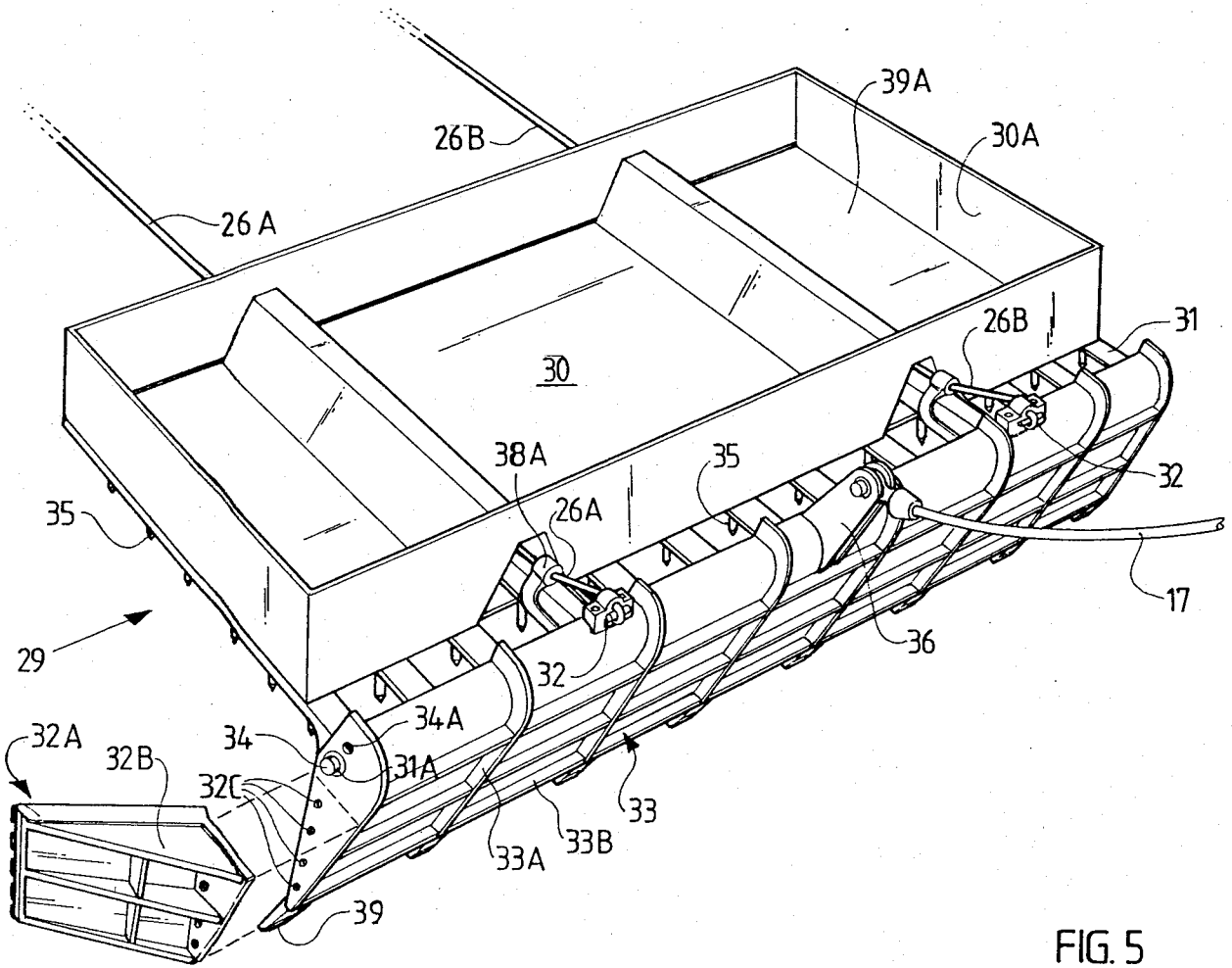
FIG. 5 represents a perspective view of the excavator hoe.
Figure 6A:
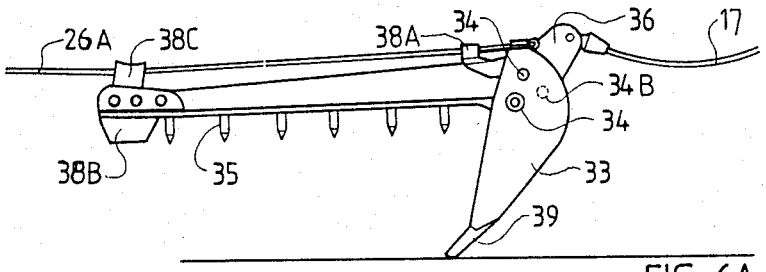
FIGS. 6A, 6B and 6C represent varying views of the excavator hoe.
Figure 6B:
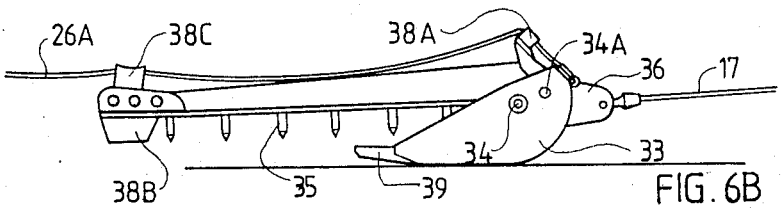
Figure 6C:
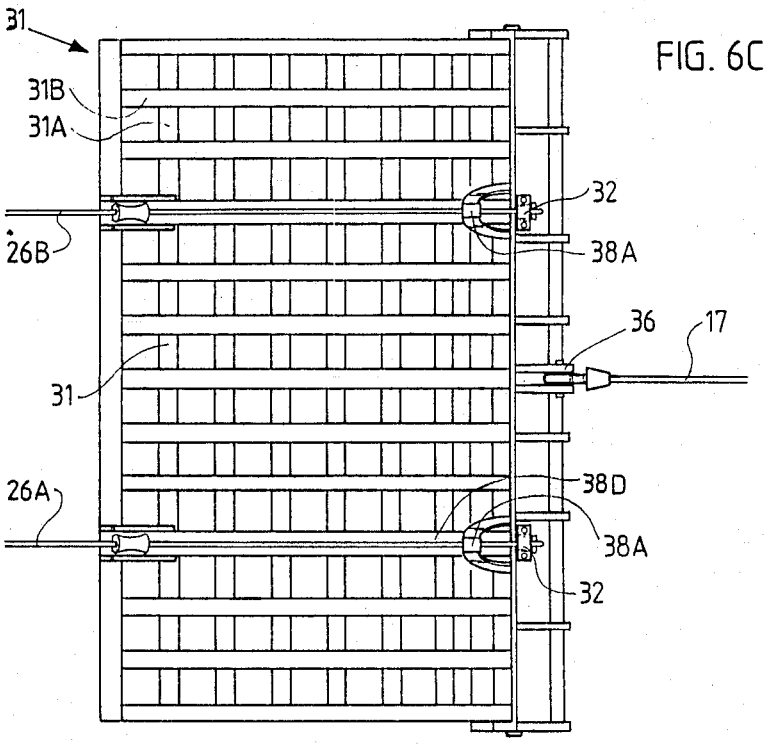

The excavating implement or hoe 29 is shown in FIGS. 5, 6A, 6B and 6C and includes a body frame 31 which may have a ballast support 30 overlying same as shown. Body frame 31 includes transverse members 31A and longitudinal members 31B as best shown in FIG. 6C. There is also included downwardly oriented scraper blade 33 which suitably is of waffle construction as shown in FIG. 5 comprising vertical reinforcement members 33A and horizontal reinforcement members 33B. Scraper blade 33 is pivotally attached to body frame 31 at 34. There is also provided opposed locking aperture 34A, scraper blade 33 and corresponding locking aperture 34A on body frame 31 which may register as shown in FIG. 6B and be locked by a locking pin to enable the hoe 29 to be hauled back for maintenance purposes without collecting a load by drag cables 26A or 26B or tail cable 17. Scraper blade 33 is provided with earth ripping tynes 39. Drag cable 26A and 26B may pass through guide channels 38 of ballast body 30 which also has top surface 39A wherein earth may be placed on top of ballast body 30 if required to assist in dragging the hoe 29 through the excavation. Body 30 may also be provided with a continuous peripheral flange 30A. Body frame 31 is also provided with retaining spikes 35 to assist in retention of scraped earth under scraper blade 33. Drag cable 26A and 26B are attached to scraper blade at 32 and there is also provided bracket 36 to which tail rope 17 is attached.

In FIGS. 6A, 6B and 6C there is also shown skid member 38B having a smooth undersurface which is attached to drag cables 26A and 26B by attachment bracket 38C. Also shown is support brackets 38A for drag cables 26A and 26B and support tracks 38D as best shown in FIG. 6B. Also shown are side scraper members 32A having reinforcing fillets 32B which may be bolted to body frame 31 by bolts 31A engaging through attachment apertures 32C.

The important features of the hoe shown in FIGS. 5, 6A, 6B and 6C as described above include the following:

(a) the inclusion of body frame 31 which also may include a perforated plate or mesh sheet within its scope ensures that the hoe 29 "floats" on the contained load when filled and prevents the load "working". The inclusion of body frame 31 will reduce the incidence of material lying on top of hoe 29 as well as providing better "bite" on the retained load, (b) the inclusion of ripping teeth 39 will enable the hoe 29 to rip overburden if required, (c) the hoe blade 33 is designed to trap some overburden during the return trip, (d) the inclusion of the pivoted or hinged blade 33 provides efficient collection of overburden during dragging operations.

Figure 7:
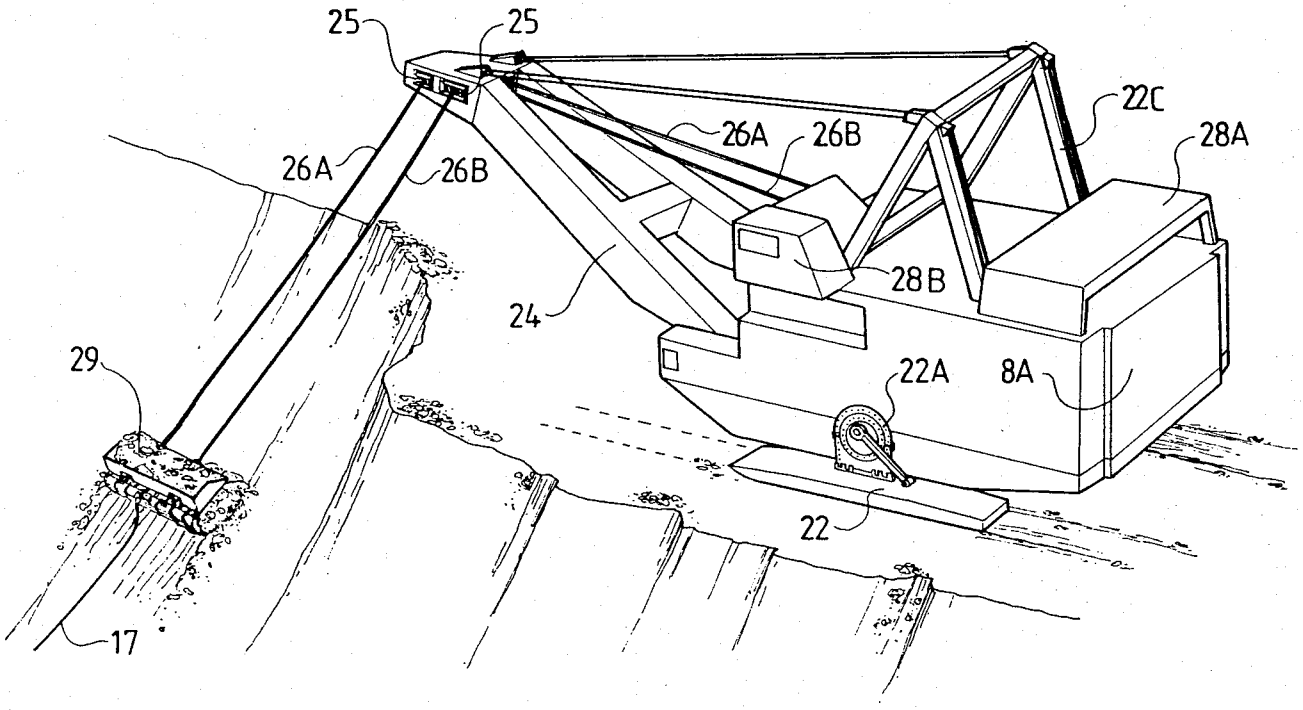
FIG. 7 represents a perspective view of a low wall winch components for use in the method of the invention.

FIG. 7 shows the low wall winch in much greater detail and dragging hoe 29 through overburden. The drag cables 26A and 26B may be passed through frame 22C mounted on top housing 8A. Suitably the walking members 22 will propel the low wall winch component 8A forward.

Figure 8:
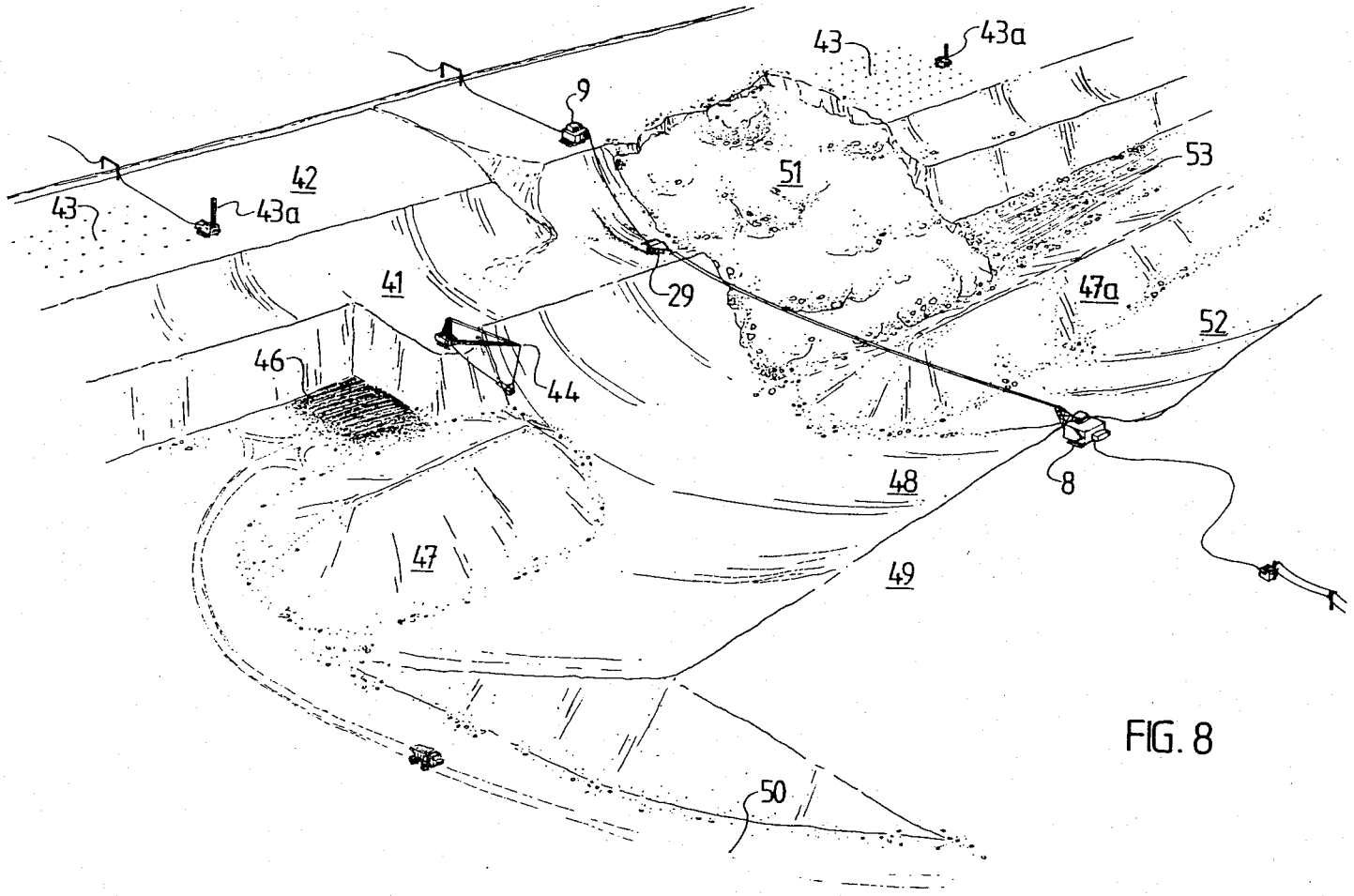
FIGS. 8, 9 and 9A represent open cut drawings illustrating various aspects of the method of the invention.
Figure 9:
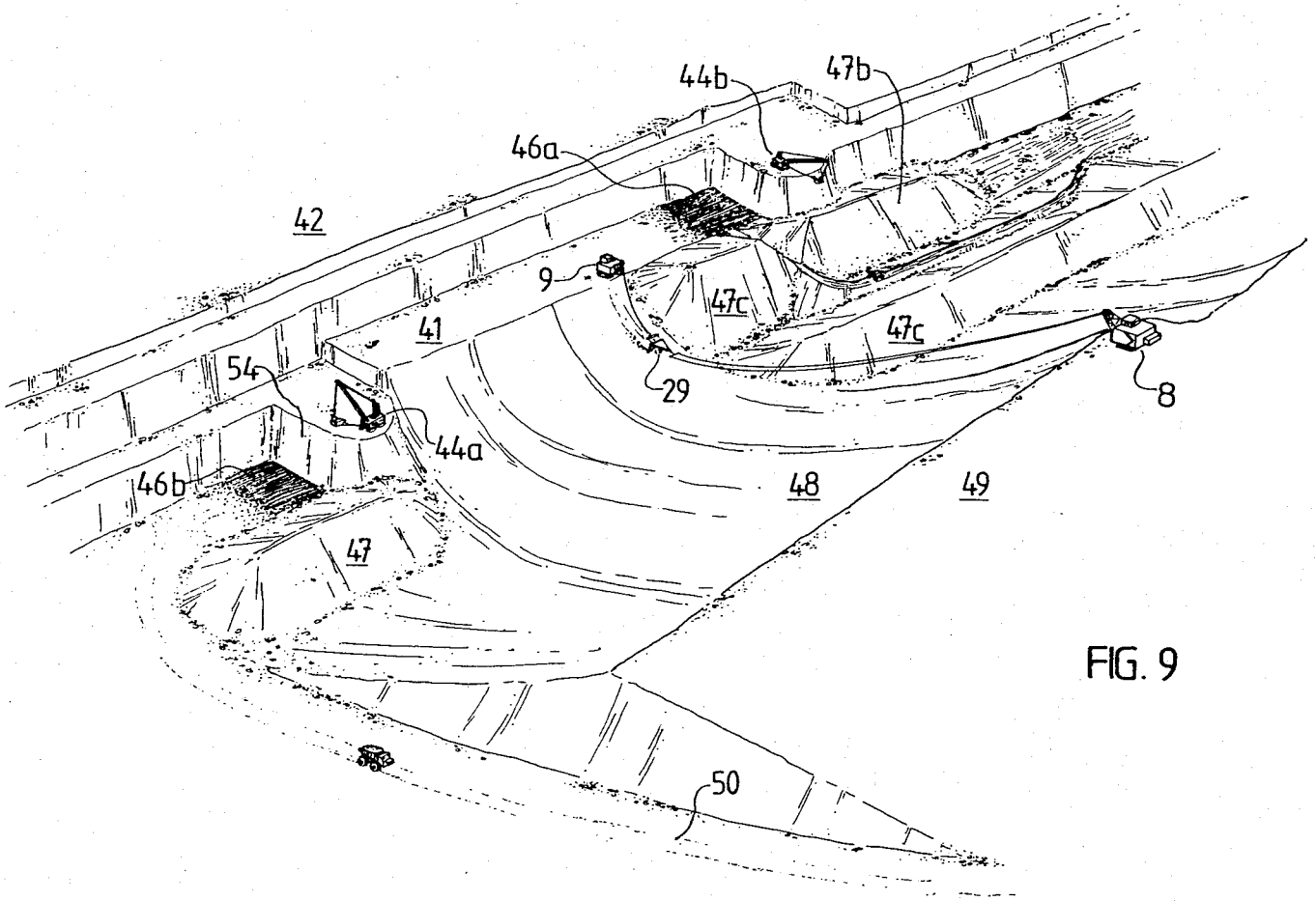

In the mining excavations shown in FIGS. 8–9 the operation of the dragline apparatus of the invention is illustrated in combination with a conventional dragline.

There is shown a prestrip zone 41, upper level 42 which may represent an area still to be mined, drilled area 43 having a plurality of drilled holes for insertion of an explosive by apparatus 43A and conventional dragline 44 mining the overburden over coal seam 46. Dragline 44 excavates as described previously by creating a spoil pile 47. However, coal seam 46 was present at a lower level than dragline 44 could reach hence it was necessary to create prestrip area or bank 41.

FIG. 8 also shows an excavator hoe 29 being pulled through overburden in zone 51 that has just been subjected to blasting after being drilled. The hoe 29 is dragged through the overburden by drag cables associated with low wall winch component 8. At the end of one pass, it is then pulled back to the desired location by the tail cable associated with high wall winch component 9. Excavated area or spoil bank 48 has been created by the dragline apparatus of the invention as well as zone 41 and FIG. 8 shows the dragline apparatus of the invention working its way upwardly as shown to clear a prior spoil pile 47A created by a conventional dragline. Area 53 has been stripped previously by a conventional dragline. There is also shown prior spoil bank 52 which is deeper than spoil bank 48. Also shown is mined area 49 and access road 50.

FIG. 9 shows the application of the dragline apparatus of the invention to multi-level coal seams 46A and 46B. Conventional dragline 44A is now excavating overburden over lower seam 46B creating the usual spoil pile 47. Also shown is the dragline apparatus of the invention represented by apparatus 8, 9 and 29 removing dragline spoil piles 47B and 47C. Dragline 44B is shown which has created spoil pile 47B. Spoil pile 47C was created by dragline 44A on a previous strip.

Figure 9A:
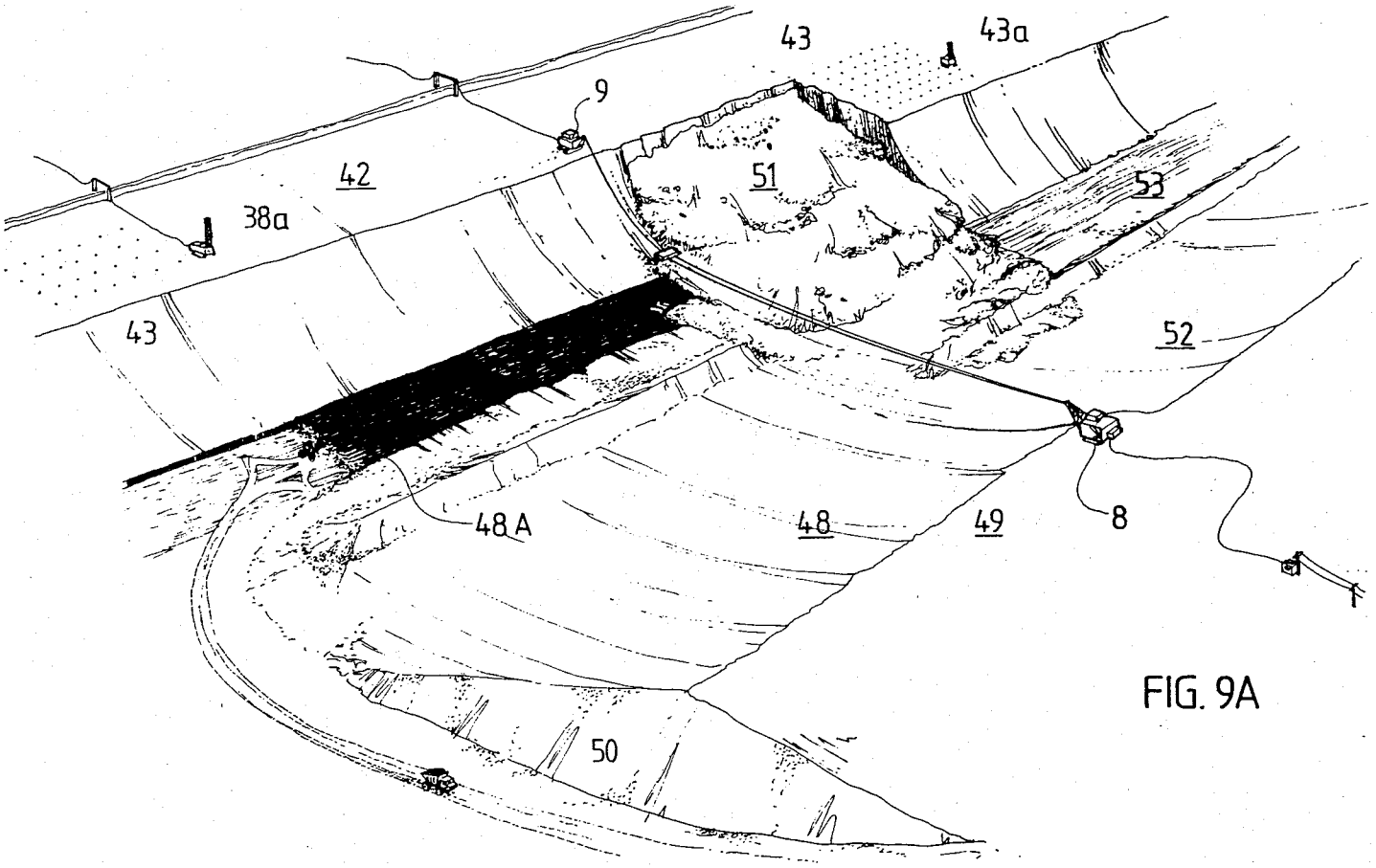

FIG. 9A shows a modified method of the invention wherein initially overburden is throwblasted at 51 and then the dragline apparatus of the invention may be utilized to mine seam 48A by creation of spoil bank 48 as described before. In this method use of the conventional dragline is not required.

Figure 10A:
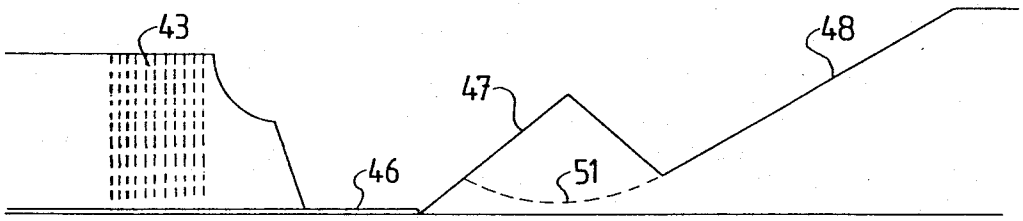
FIGS. 10A, 10B and 10C represent schematic side views illustrating the method of excavation shown in FIG. 8.
Figure 10B:
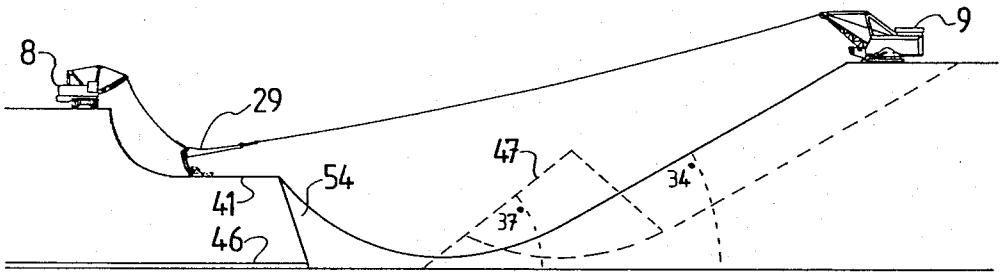
Figure 10C:
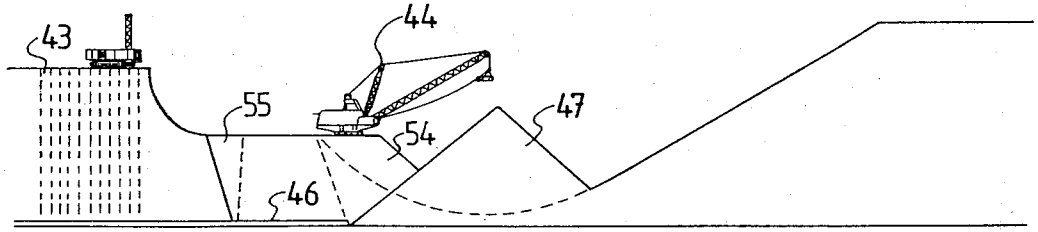

FIGS. 10A, 10B and 10C show the operation of the dragline apparatus of the invention in relation to a single level coal seam 46. In FIG. 10A a part of coal seam 46 is exposed having been mined by a conventional dragline creating spoil pile 47. The original level 51 is shown in phantom as well as drilled area 43.

In FIG. 10B low wall winch component 9 in combination with high wall winch component 8 and hoe 29 is being used to reclaim the dragline spoil represented by pile 47. The slope angle of spoil bank 48 is preferably lower than the slope angle of spoil pile 47 (i.e. 34 degrees compared to 37 degrees). Prestrip zone 41 is also created by apparatus 8–9 as well as the initial construction of dragline bridge 54.

In FIG. 10C the dragline apparatus of the invention is used to cut a key cut 55 whereby the excavated material cut therefrom is deposited on the bridge 54. The bridge 54 is used to support a conventional dragline 44 as shown which is then utilised to uncover coal seam 46.

Figure 11A:
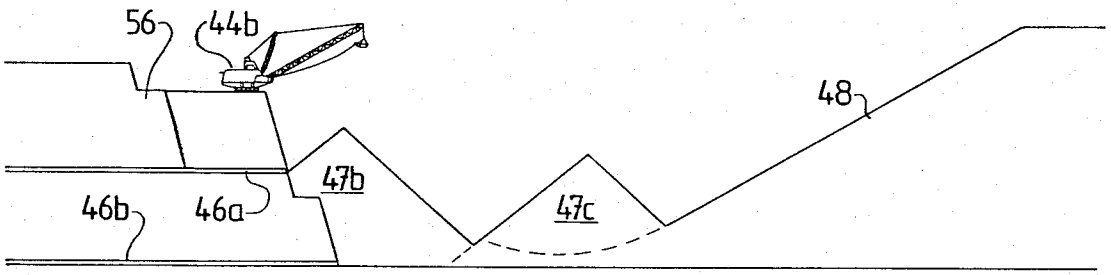
FIGS. 11A, 11B and 11C represent schematic side views illustrating the method of excavation shown in FIG. 9.
Figure 11B:
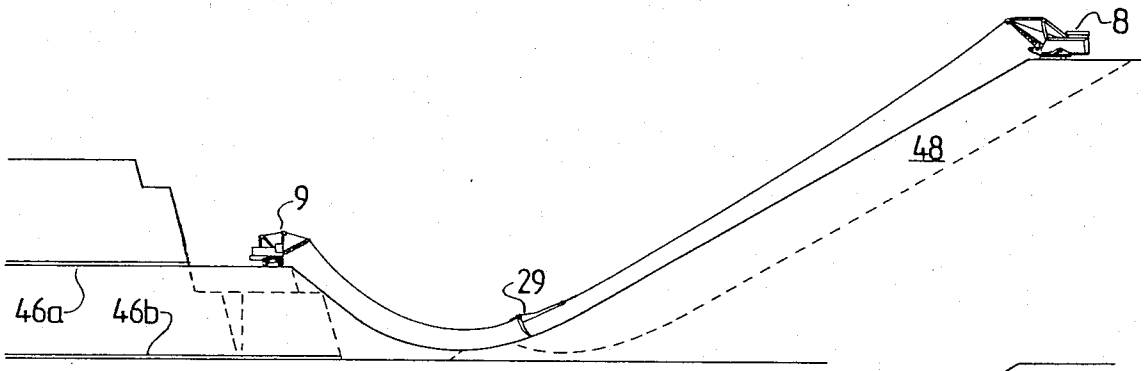
Figure 11C:
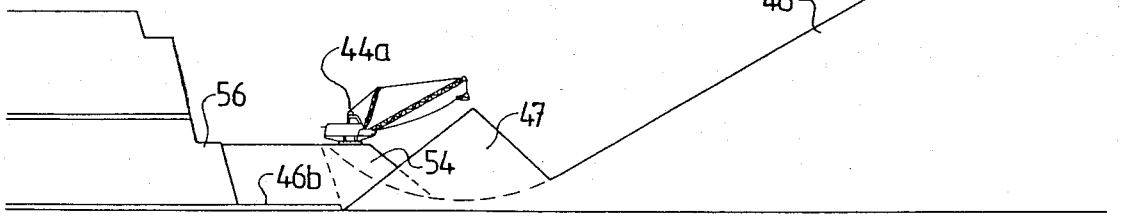

In relation to multiple coal seam mining as shown in FIGS. 11A, 11B and 11C conventional dragline 44B is used to chop cut ahead as shown in 56 in FIG. 11A and then side cast or take overburden to uncover coal seam 46A and dump the overburden on spoil pile 47B.

In FIG. 11B after mining of coal seam 46A the dragline apparatus of the invention is then used to excavate the conventional dragline spoil as described previously in FIG. 9 to create spoil bank 48 and also to initially construct dragline bridge 54 as described in FIG. 9. The overburden is then stripped by conventional dragline 44A as shown in FIG. 11C wherein a chop cut 56 is made and the bridge 54 is completed. The overburden over lower coal seam 46B is then removed and spoil pile 47 is then started in the usual manner.

It will also be appreciated from the foregoing that the dragline apparatus of the invention may be used without the conventional dragline 44 in mining operations if desired. It will also be appreciated that the invention not only covers the improved dragline apparatus but also the method of excavation using same described herein.

The term "low wall" as used herein refers to the side or wall of the excavation where the coal has been previously removed. The opposite side of the excavation is referred to as the "high wall". In FIG. 11B the low wall appears to be higher than the high wall due to the swelling effect of loosened overburden and this may often occur in practice during an excavation of a sloping coal seam.

The dragline apparatus of the invention may also be used to shift overburden previously shifted trucks and shovels, crushers, conveyors, dredges and pipelines.

In regard to the preferred embodiment of the invention, it will be appreciated especially in regard to FIGS. 8, 9, 10A–10C and 11A–11C that the dragline apparatus of the invention may carry out the following steps:

(i) it loosens some forms of in site overburden;

(ii) it transports the overburden horizontally over varying distances, and (iii) elevates the overburden through varying heights.

In further variation of the above it will be appreciated that there could be employed a plurality of high wall winches (e.g. two) to drag the excavating implement.

Also the dragline apparatus of the invention will be found advantageous in reducing geotechnical problems associated with the slope angle of spoil banks and reduce the cost of removing overburden.

What is claimed is:

1. A method of excavating overburden from a mineral or coal deposit seam using a low wall winch component, a high wall winch component and a hoe, the hoe including an upper body frame and a downwardly extending scraper blade attached to the rear end of the body frame, and the hoe being attached to the low wall winch component by one or more draglines and to the high wall winch component by a tail line, the method including the steps of:

(i) moving the hoe by tensioning of the dragline or draglines by the low wall winch component through overburden created by preliminary drilling and blasting to move the overburden away from the mineral or coal deposit seams in one or more traverses wherein overburden is scraped into the hoe, transported thereby and subsequently dumped onto a spoil bank; and (ii) moving the hoe at the end of each traverse by untensioning of the dragline or draglines by the low wall winch component and tensioning of the tail line by the high wall winch component;

and wherein step (i) includes floatingly supporting the upper body frame of the hoe at a generally horizontally disposed bottom surface thereof on a load of scraped overburden being transported by the hoe and using plural spike-like elements extending downwardly from the bottom surface to retain the load of scraped overburden under the hoe, thereby to minimize working of the load of scraped overburden during transport.

2. A method as set forth in claim 1, wherein said bottom surface includes at least one of a generally horizontal plate and mesh sheet.

3. A method as set forth in claim 1, wherein the area to be excavated is drilled and throw blasted prior to excavation.

4. A method as set forth in claim 1, wherein the scraper blade of the hoe includes side scraper members projecting forwardly from respective ends of the scraper blade.

5. A method of excavating overburden from a mineral or coal deposit seam using a low wall winch component, a high wall winch component and a hoe, the hoe including an upper body frame and a downwardly extending scraper blade pivotally attached to the rear end of the body frame, and the hoe being attached to the low wall winch component by one or more draglines and to the high wall winch component by a tail line, the method including the step of creating a pre-strip zone and spoil bank over the mineral or coal deposit seam by:

(i) moving the hoe by tensioning of the dragline or lines by the low wall winch component through overburden created by preliminary drilling and blasting to move an upper layer of the overburden away from the mineral or coal deposit seams in one or more traverses to create a pre-strip zone wherein the layer of overburden is scraped into the hoe, transported thereby and subsequently dumped onto a spoil bank;

(ii) moving the hoe at the end of each traverse by untensioning of the dragline or lines by the low wall winch component and tensioning of the tail line by the high wall winch component; and (iii) excavating remaining overburden over the mineral or coal deposit by secondary excavating means located on or adjacent the pre-strip zone;

and wherein step (i) includes floatingly supporting the upper body frame of the hoe at a generally horizontally disposed bottom surface thereof on a load of scraped overburden being transported by the hoe and using plural spike-like elements extending downwardly from the bottom surface to retain the load of scraped overburden under the hoe, thereby to minimize working of the load of scraped overburden during transport.

6. A method as set forth in claim 5, wherein during step (i) a cut is made in the pre-strip zone and material excavated therefrom is deposited adjacent the seam to form a bridge for supporting said second excavating means which is then utilized to uncover the seam.

7. A method as set forth in claim 5, wherein said bottom surface includes at least one of a generally horizontal plate and mesh sheet.

8. A method as set forth in claim 5, wherein the scraper blade of the hoe includes side scraper members projecting forwardly from respective ends of the scraper blade.

9. A method of excavating a multi-seam mineral or coal deposit wherein a first mineral or coal deposit seam is uncovered by secondary excavating means which removes the overburden from the seam and dumps the overburden on an adjacent spoil bank whereafter the seam is mined, the adjacent spoil bank is removed and a support bridge for the secondary excavating means is created using a low wall winch component, a high wall winch component and a hoe, the hoe including an upper body frame and a downwardly extending scraper blade pivotally attached to the rear end of the body frame, and the hoe being attached to the low wall winch component by one or more draglines and to the high wall winch component by a tail line, the overburden being moved and the bridge created by the steps of:

(i) moving the hoe by tensioning of the dragline or lines by the low wall winch component through overburden to move the overburden away from a second lower mineral or coal seam in one or more traverses wherein the overburden is scraped into the hoe, transported thereby and formed into a bridge;

(ii) moving the hoe at the end of each traverse to a return position by untensioning of the dragline or lines and tensioning of the tail line by the high wall winch component; and (iii) thereafter excavating the second mineral or coal deposit seam by secondary excavating means supported by the bridge;

and wherein step (i) includes floatingly supporting the upper body frame of the hoe at a generally horizontally disposed bottom surface thereof on a load of scraped overburden being transported by the hoe and using plural spike-like elements extending downwardly from the bottom surface to retain the load of scraped overburden under the hoe, thereby to minimize working of the load of scraped overburden during transport.

10. A method as set forth in claim 9, wherein said bottom surface includes at least one of a generally horizontal plate and mesh sheet.

11. A method as set forth in claim 9, wherein the scraper blade of the hoe includes side scraper members projecting forwardly from respective ends of the scraper blade.

12. Apparatus for excavating overburden comprising:

(i) a low wall winch component including a housing, a boom extending outwardly of said housing and supporting one or more draglines, winch means rotatably carrying said one or more draglines, drive means for actuating said winch means, and traversing means supporting said housing;

(ii) a high wall winch component including a housing, a boom extending outwardly of said housing and supporting a tail line, winch means rotatably carrying said tail line, drive means for actuating said winch means, and traversing means supporting said housing; and (iii) an excavating hoe attached to said one or more draglines and to said tail line for traversing said hoe, said hoe including an upper body frame and a scraper blade pivotally attached to the rear end of said body frame, said blade being pivoted to a material scraping position when said hoe is traversed in a forward direction by said dragline or draglines for scraping material and advancing a load of scraped material forwardly of said scraping blade, said blade being reversely pivoted to a forwardly extending return position when said hoe is traversed by said tail line, and said body frame having generally horizontally disposed bottom surface means for floating said body on the load of scraped material advanced by said scraper blade and plural spike means extending downwardly from said bottom surface means for retaining scraped material under said hoe, whereby working of the load of scraped material is minimized.

13. An apparatus as set forth in claim 12, wherein said bottom surface includes at least one of a generally horizontal plate and mesh sheet.

14. An apparatus as set forth in claim 13, wherein said bottom surface means is a mesh sheet, and said mesh sheet includes transverse and longitudinal members.

15. An apparatus as set forth in claim 12, further comprising ballast means supported on said upper body frame.

16. An apparatus as set forth in claim 12, wherein said excavating hoe includes means for locking said scraper blade in a forwardly extending position whereby said hoe may be hauled for maintenence without collecting a load.

17. An apparatus as set forth in claim 12, wherein said scraper blade has side scraper members projecting forwardly from respective sides thereof.

18. A hoe for use in excavating overburden, comprising: an upper body frame, a scraper blade pivotally attached to a rear end of said body frame, means for connecting said hoe to one or more draglines for moving said hoe in a forward direction, and means for connecting the hoe to a tail line for moving the hoe in a rearward direction, said blade being pivoted to a material scraping position when said hoe is traversed in a forward direction by the dragline or draglines for scraping material and advancing a load of scraped material forwardly of said scraping blade, said blade being reversely pivoted to a forwardly extending return position when said hoe is traversed by the tail line in a rearward direction, and said body frame having generally horizontally disposed bottom surface means for floating said body on the load of scraped material advanced by said scraper blade and plural spike means extending downeardly from said bottom surface means for retaining scraped material under said hoe, whereby working of the load of scraped material is minimized.

19. A hoe as set forth in claim 18, wherein said bottom surface includes at least one of a generally horizontal plate and mesh sheet.

20. A hoe as set forth in claim 19, wherein said bottom surface means is a mesh sheet, and said mesh sheet includes transverse and longitudinal members.

21. A hoe as set forth in claim 18, further comprising ballast means supported on said upper body frame.

22. A hoe as set forth in claim 18, wherein said excavating hoe includes means for locking said scraper blade in a forwardly extending position whereby said hoe may be hauled for maintenance without collecting a load.

23. A hoe as set forth in claim 18, wherein said scraper blade has side scraper members projecting forwardly from respective sides thereof.

* * * * *